United States Patent [19]

Herman

[11] Patent Number: 4,750,634

[45] Date of Patent: Jun. 14, 1988

[54] PRIMER CAP

[76] Inventor: Charles Herman, P.O. Box 142, Cyril, Okla. 73029

[21] Appl. No.: 858,931

[22] Filed: May 2, 1986

[51] Int. Cl.[4] ..... F04B 45/02

[52] U.S. Cl. ..... 220/85 B; 137/145

[58] Field of Search ..... 220/85 A, 85 B; 215/4, 215/271, 307, 309; 137/142, 145, 147, 152

[56] References Cited

U.S. PATENT DOCUMENTS

| | | | |
|---|---|---|---|
| 754,132 | 3/1904 | Fulton | 137/145 X |
| 781,939 | 2/1905 | Fulton | 220/85 B |
| 1,372,715 | 3/1921 | Morledge | 137/145 X |
| 2,040,798 | 5/1936 | Schoonmaker | 215/271 |
| 2,680,477 | 6/1954 | Schira, Jr. . | |
| 2,956,737 | 10/1960 | Hager . | |
| 3,216,198 | 11/1965 | Brooks | 220/85 B X |
| 3,345,045 | 10/1967 | Tuggle . | |
| 3,693,825 | 9/1972 | Richman | 220/85 B X |

*Primary Examiner*—Steven M. Pollard

*Attorney, Agent, or Firm*—Young & Thompson

[57] ABSTRACT

A gas priming device combining a resilient bellows in combination with an open cap having an inwardly directed annular flange. The lowermost repeating bellows unit is enclosed and encircled by the inwardly directed annular flange of the cap, so that when the cap is secured to a gas supply conduit, the lowermost repeating bellows unit is squeezed between the upper end surface of the conduit and the inwardly directed annular flange, to form a sealing gasket for the priming device. Priming is effected by covering the hole disposed on the upper end of the bellows and compressing the bellows in the direction of fuel feed.

7 Claims, 1 Drawing Sheet

FIG. 1
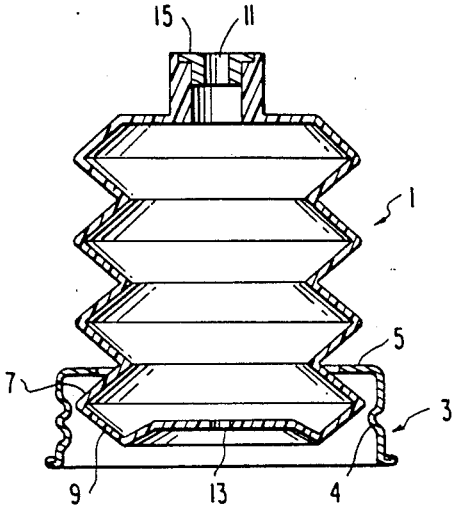
FIG. 2
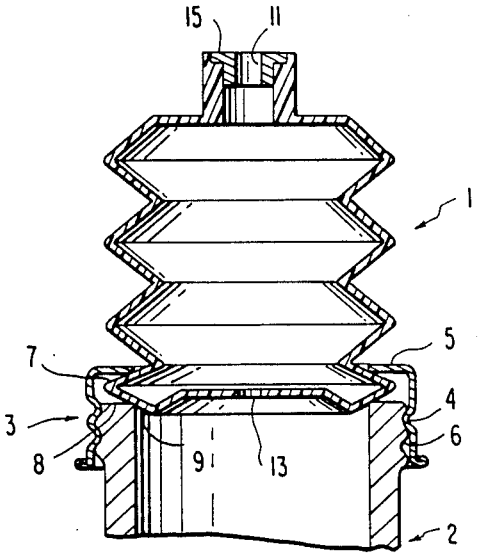
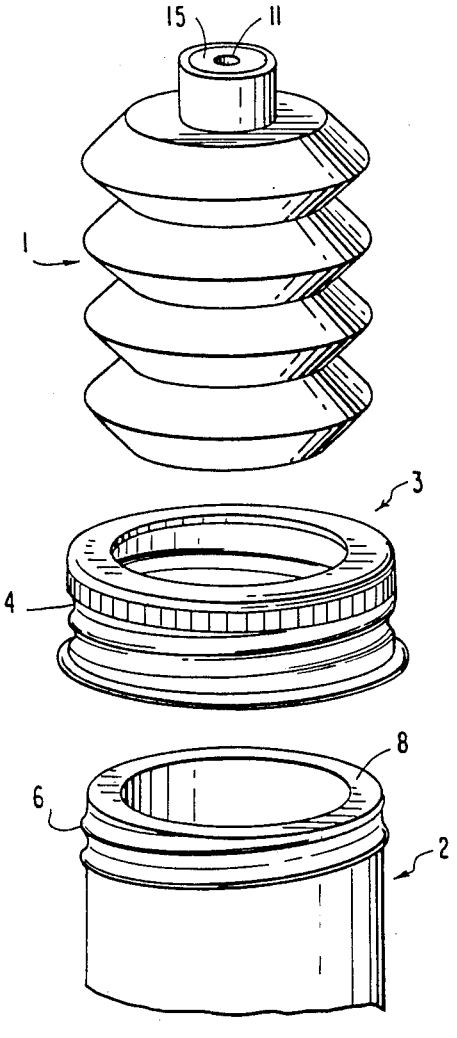
FIG. 3
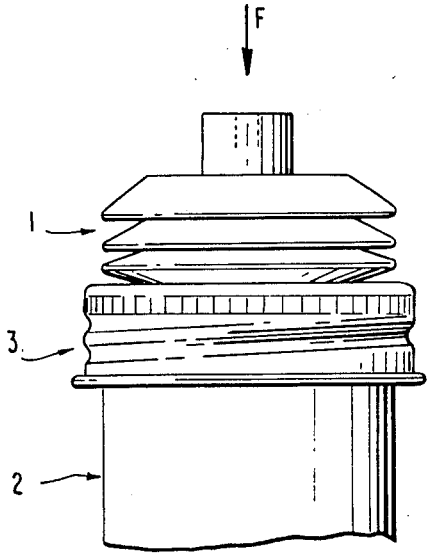
FIG. 4

PRIMER CAP

The present invention relates to gas caps for small engines having the fuel tank, or some portion of the fuel line, below the carburetor. It further relates to such a cap having a bellows which allows priming the engine by placing a finger over a hole in the top of the bellows, and depressing. These engines are typically found on lawnmowers, snow blowers, tillers, pumps, generators, etc., and are commonly hard to start.

The concept of combining a manually operated bellows with a gas cap is known. U.S. Pat. No. 2,680,477 to Schira, Jr., shows such a priming cap. Although this patent to Schira shows an aspirator hole sealed by flap valves, the bellows of the patent to Schira, Jr. could be simplified, for example, in view of U.S. Pat. No. 3,345,045 to Tuggle. A useful combination of these two patents would be to simplify the flap valves of the patent to Schira, Jr. by replacing them with a simple aspirator hole, as taught by the patent to Tuggle.

There remains the difficulty, however, that the quality of the priming effected by such a bellows-type priming cap can only be as good as the connection between the bellows and the cap.

It is accordingly a principal object of the present invention to provide a priming gas cap in which a bellows and a gas cap are so designed and combined that the bellows performs the unique dual function of serving not only as a conventional priming pump, but also as a sealing gasket for the gas cap.

It is a further object of the present invention to provide a priming gas cap that is inexpensive to manufacture, and simple to use.

Other objects and advantages will become apparent from the following description taken in conjunction with the accompanying drawings, in which:

FIG. 1 is a cross-sectional side view of the primer cap of the present invention;

FIG. 2 is a cross-sectional side view of the primer cap of the present invention, shown in assembled relation with a gas supply conduit;

FIG. 3 is an exploded view of the primer cap of the present invention and the gas supply conduit to which it is to be secured; and FIG. 4 is a side view of the primer cap of the present invention with its bellows depressed, shown in assembled relation with the gas supply conduit to which it is to be secured.

Referring now to the drawings in more detail, there is shown in FIG. 1 the primer cap of the present invention, which comprises a bellows 1 and a screw cap 3. The bellows has at its top end a thumb hole 11. This thumb hole 11 may be formed directly in the bellows 1, or may be provided by a metal thumb-hole insert 15, as shown.

The bellows 1 additionally comprises an outlet hole 13 at its lower end.

The bellows 1 shown comprises four repeating bellows units, the lowermost of which repeating units comprises an upper bellows surface 7, and a lower bellows surface 9. Although the bellows shown has four bellows units, it will be understood that the number of bellows units may be varied, as a matter of design choice, from a minimum of two to whatever desired maximum value.

The lowermost repeating bellows unit is encircled by and enclosed in the screw cap 3. The screw cap 3 essentially comprises an annular band having internal screw threading 4, and an inwardly directed annular flange 5 integral with the cap.

The bellows 1 of the present invention may be formed from any suitable flexible material, and is preferably plastic or rubber. Similarly, the screw cap 3 may be formed from any suitable rigid material, and is preferably metal.

It will therefore be seen that the screw cap 3 and bellows 1 may be manufactured independently of each other, and assembled simply by compressing the lowermost repeating bellows unit of the bellows 1 until it fits inside the inwardly directed annular flange 5 of the screw cap 3.

The primer cap of the present invention is designed to be used in combination with a gas supply conduit 2 (see FIGS. 2–4). As can be seen in FIG. 3, the supply conduit 2 comprises external screw threading 6 and an end surface 8. The internal screw threading 4 of the screw cap 3 is designed to cooperate with this external screw threading 6 of the supply conduit 2, while the inwardly directed annular flange 5 of the screw cap 3 is designed to extend inwardly at least as far as the inner diameter of the supply conduit 2, but not so far as the lesser circumference of the bellows 1.

As can be seen in FIG. 2, when the primer cap of the present invention is screwed onto a gas supply conduit 2, the lowermost repeating bellows unit is compressed between the end surface 8 of the gas supply conduit 2 and the inwardly directed annular flange 5 of the screw cap 3. Specifically, the lower bellows surface 9 is pressed against the end surface 8 of the gas supply conduit 2, and the upper bellows surface 7 is pressed against the inwardly directed annular flange 5. In this way, the lowermost repeating bellows unit serves as a resilient sealing gasket for the primer cap.

It will be noted that, by virtue of the arrangement of the present invention, the primer cap need not be fully engaged on the gas supply conduit 2 for the lowermost repeating bellows unit to realize its gasket function. As soon as the upper and lower bellows surfaces 7, 9 are simultaneously in contact with the inwardly directed annular flange 5 and upper end surface 8, respectively, the seal is formed, the natural resilience of the bellows material augmenting this seal.

The operation of the present invention is as follows:

The user first screws the primer cap of the present invention onto a gas supply conduit 2 of the engine he desires to prime. The user screws the primer cap onto the conduit 2 at least until the upper and lower surfaces 7, 9 of the lowermost repeating bellows unit are contacted by the inwardly directed annular flange 5 of the screw cap 3 and the upper end surface 8 of the conduit 2, respectively (see FIG. 2).

The user then covers the thumb hole 11 with his thumb or finger and presses downwardly in the direction of the arrow F shown in FIG. 4. This downward pressure forces a volume of air against the fuel stored in the fuel tank, this volume corresponding to the difference in volume between the expanded and compressed bellows 1. The volume of air thus forced against the fuel of the fuel tank displaces a corresponding amount of fuel, thereby introducing a portion of raw fuel into the intake area of the engine that it is desired to prime. The amount of raw fuel thus introduced into the intake area of the engine may be regulated by the number of bellows units, and hence the extent of the bellows 1, and by the number of depressions to which the bellows is subjected by the user. As a result of this charge of raw fuel having been introduced into the intake area of the engine, the engine starts readily when cranked or turned over.

Additional advantages of the primer cap of the present invention are that it allows first-crank starting of an engine at negligible cost to the consumer, persons with physical limitations are able to start such equipment, wear and tear on starting components is greatly reduced, and quick starting of emergency equipment is assured when time is of the essence.

Although the present invention has been described in conjunction with a preferred embodiment, it is to be understood that modifications and variations may be resorted to without departing from the spirit and scope of the invention as those skilled in the art will readily understand. For example, the internal screw threading 4 of the screw cap 3 may be replaced by inwardly directed pegs designed to cooperate with slots provided on a gas supply conduit 2. Such modifications and variations are considered to be within the purview and scope of the invention and appended claims.

What is claimed is:

1. A priming gas cap to be secured to a gas supply conduit having securement means and an end surface, said cap comprising a resilient bellows having at least two repeating bellows units, and two opposite ends, said bellows further comprising a hole at each said opposite end; and a cap member, said cap member being formed from an essentially cylindrical element having fastening means designed to cooperate with gas cap fastening means of a gas supply conduit, and an inwardly directed annular flange formed integrally from said essentially cylindrical portion and extending radially inwardly from said cylindrical portion to define a circular opening in said cap member, the lowermost repeating bellows unit of said bellows being encircled and enclosed by said inwardly directed annular flange of said cap member, said lowermost repeating bellows unit having a minimum diameter less than the diameter of said circular opening and a maximum diameter greater than the diameter of said circular opening and underlying said flange.

2. Priming cap according to claim 1, wherein said fastening means of said cylindrical portion is screw threading formed on the inner wall of said cylindrical portion, and said fastening means of said gas supply conduit is external screw threading, said internal screw threading being designed to cooperate with said external screw threading.

3. Priming device according to claim 1, wherein said cap is metal.

4. Priming device according to claim 1, wherein said bellows is rubber.

5. Priming device according to claim 1, wherein said bellows is plastic.

6. Priming device according to claim 1, wherein said two opposite ends of said resilient bellows comprise a first end adjacent the uppermost of said at least two repeating bellows units, said first end having applied thereto an apertured member formed from material different than said resilient bellows, said apertured member having an aperture aligned with said hole of said first end.

7. Priming device according to claim 1, wherein said repeating bellows unit adjacent said lowermost repeating bellows unit has a maximum diameter greater than the diameter of said circular opening and overlying said flange.

* * * * *